United States Patent [19]

Johnson

[11] Patent Number: 5,055,813

[45] Date of Patent: Oct. 8, 1991

[54] MAGNETIZATION/DEMAGNETIZATION DEVICE

[76] Inventor: Terry R. Johnson, 4 Huguenot Rd., Newport News, Va. 23606

[21] Appl. No.: 544,987

[22] Filed: Jun. 28, 1990

[51] Int. Cl.[5] ..... H01F 7/20; H01F 13/00; H01H 47/00

[52] U.S. Cl. ..... 335/284; 361/142; 361/143; 361/149

[58] Field of Search ..... 335/284; 361/142, 143, 361/149, 267; 336/66

[56] References Cited

U.S. PATENT DOCUMENTS

| | | | |
|---|---|---|---|
| 4,030,002 | 6/1977 | Alexandrovich et al. | 335/284 |
| 4,086,644 | 4/1978 | Horian et al. | 361/149 |
| 4,873,605 | 10/1989 | Drits et al. | 361/143 |

FOREIGN PATENT DOCUMENTS

| | | | |
|---|---|---|---|
| 3543678 | 6/1987 | Fed. Rep. of Germany | 335/284 |

*Primary Examiner*—Leo P. Picard
*Assistant Examiner*—Ramon M. Barrera
*Attorney, Agent, or Firm*—Olive & Olive

[57] ABSTRACT

A compact, portable magnetization/demagnetization device comprises a tubular housing internally of which at one end is mounted an electrical coil which surrounds a cavity accessible to screwdrivers and the like. At the opposite end of the housing there is mounted a pair of AC prongs. A manually operated switch on the housing permits the coil to be energized when the prongs are energized to establish a magnetic field in the cavity for the purpose of magnetizing and demagnetizing tools and other objects.

7 Claims, 3 Drawing Sheets

MAGNETIZATION/DEMAGNETIZATION DEVICE

BACKGROUND OF INVENTION

1. Field of the Invention

The invention relates to a portable and compact device for magnetizing and demagnetizing tools and other objects.

2. Background Art

Mechanics and other repair and service persons often have a need to be able to conveniently magnetize or demagnetize the ferrous metal portions of tools or other items. For example, when working with electrical devices, the shaft of a screwdriver frequently becomes magnetized, which can be an inconvenient state when the screwdriver is inappropriately drawn toward or sticks to surfaces or small objects. It is obviously desirable to have a convenient means to demagnetize the screwdriver. In another context, it may be desirable to make the screwdriver itself magnetic, for example to sink ferrous screws into a recessed location where they cannot be conveniently held until the threads can be sunk an adequate distance to hold the screw in alignment. It is known in the art that immersion of ferrous objects in a magnetic field can be advantageously used to magnetize or demagnetize the objects, and prior art devices do exist for the purpose of magnetization and demagnetization also called degaussing. However, such devices are typically too cumbersome to be carried around in an ordinary tool kit, and often do not have flexible configurations.

SUMMARY OF THE INVENTION

The present invention comprises a portable and compact magnetization/demagnetization device. The device has an armature frame composed of a dielectric material, and has a cavity which is referred to as a barrel and which extends from one end of the armature frame inward toward the middle of the device. A coil of electrically conductive wire is wound around the outside of the armature frame in coaxial alignment with the barrel. The ends of the coil are connected to the prongs of a plug suitable for an ordinary wall electrical outlet through a manually operable switch. A magnetic field permeating the barrel is induced when the coil is energized by closing the switch.

One end of the barrel is open to the outside in order to admit items into the barrel for magnetization and demagnetization, and has a sufficient depth and diameter so that a tool such as the shaft of a screwdriver can be inserted into the barrel up to at least part of its length. The opposite end of the barrel is padded with a tool cushion made out of a material such as hard rubber, to absorb the impact of objects, such as screwdriver shafts, which are inserted into the barrel. Magnetization is achieved by holding objects stationary for an appreciable length of time in the barrel while the coil winding is energized, e.g. at least one second for a typical screwdriver shaft. Demagnetization is achieved by slowly withdrawing the object from the barrel while the coil winding is energized.

There are two alternative augmentations to the device, the first comprising a pick-up probe and the second comprising a degaussing probe, each comprised of magnetizable material. Each of the probes has a handle end shaped so that it can be removably inserted in the barrel of the device. Each probe works by effectively extending the magnetic field from the barrel. The primary difference between the two probes lies principally in their respective geometries, which are adapted for different purposes. The pick-up probe has a lower end shaped most suitably as a thin cylindrical shaft and terminating in a blunt tip, suitable for insertion into narrow wells or shafts to retrieve ferrous objects when the coil winding is energized and releasing the same when the coil winding is deenergized. The degaussing probe has a lower end shaped most suitably as a gradually tapering cylinder. The degaussing probe is used by placing it in proximity to the object to be demagnetized, energizing the coil winding, and then gradually withdrawing the degaussing probe from the object.

DESCRIPTION OF PREFERRED EMBODIMENT

Figure 1:
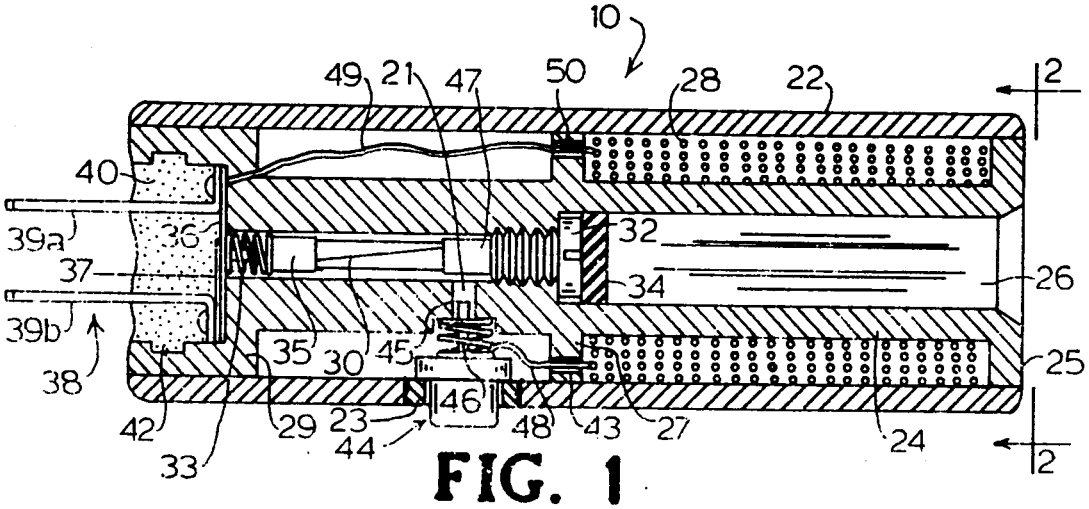
FIG. 1 is a sectional view of the magnetizer/demagnetizer device of the invention.
Figure 2:
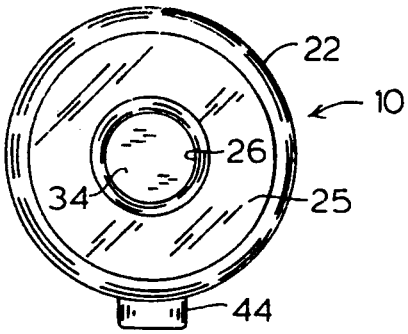
FIG. 2 is an end view of the magnetizer/demagnetizer device, taken in the direction of line 2—2 of FIG. 1.
Figure 3:
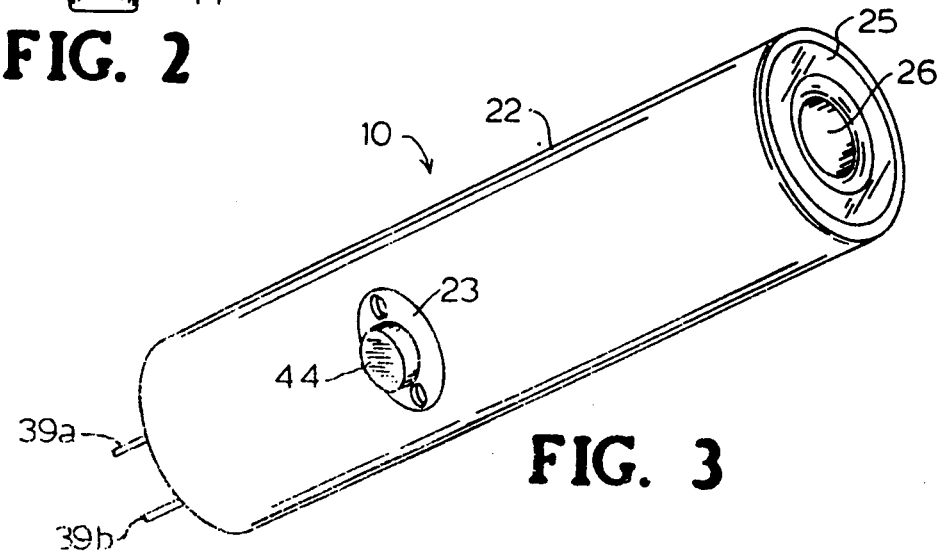
FIG. 3 is a perspective view of the magnetizer/demagnetizer device.

According to the invention, a magnetizer/demagnetizer device 10 is encased in a molded housing 22, composed of any suitable nonmagnetic, dielectric material. In the preferred embodiment, housing 22 is cylindrical in shape and is made of plastic. Inside of housing 22 there is mounted a coaxially centered, molded, armature frame 24, also composed of any suitable nonmagnetic dielectric material such as the plastic used for the housing 22. Armature frame 24 is supported inside housing 22 by three separate annular structures; a front armature frame support 25, a middle armature frame support 27, and a rear armature frame support 29. Armature frame supports 25, 27, 29 each engage the interior surface of the housing 22 and each extend around the interior circumference of housing 22. Armature frame 24 and armature frame supports 25, 27, 29 are illustrated in FIG. 1 as being formed together of a single unitary piece of molded plastic material. However, it is recognized that armature frame 24 and armature frame supports 25, 27, 29 could be made as separate parts and assembled in the configuration shown.

In the region between the middle armature frame support 27 and the front armature frame support 25, armature frame 24 is shaped as a hollow cylinder, coaxially centered within the larger surrounding cylindrical housing 22. The interior surface of this portion of the armature frame 24 defines a barrel 26 which comprises a cylindrical cavity in armature frame 24. The barrel 26 is open to the outside at the front end of the device 10, thus allowing objects or probes to be inserted into the barrel 26 for magnetization or demagnetization. The barrel 26 is terminated proximate the location of middle armature frame support 27 by a circular tool cushion 34 extending across the diameter of barrel 26. Tool cushion 34 is composed of a suitable nonconducting padding material, such as moderately hard rubber, which can withstand and cushion repeated moderate impact from, e.g. the end of a screwdriver. The tool cushion 34 in turn rests against the head of a later described fuse access cap screw 32.

In the region between the front armature frame support 25 and the middle armature frame support 27, sufficient space is left between the exterior of armature frame 24 and the interior of said device housing for windings 28. Windings 28 form a continuous coil of electrically conductive wire about barrel 26, and are used to implement the field necessary for effecting magnetization or demagnetization. In one model of device 10, 400 turns of #30 insulated copper magnet wire were used for the windings 28. As would be appreciated in the art, the strength of the generated magnetic field depends on the current carried and the number of turns, and accordingly, it would be possible to set up a suitable field in the windings 28 using various alternative combinations of wire gage and number of turns.

In the region between the middle armature frame support 27 and the rear armature frame support 29, the armature frame 24 is shaped as a hollow cylinder, coaxially centered within the larger surrounding cylindrical housing 22. The hollow center of this portion of the armature frame 24 is shaped to house in closely nested fashion both the fuse access cap screw 32 formed of a dielectric material and a fuse 30. Immediately rearward of the middle armature frame support 27, the hollow center of the armature frame 24 is shaped to mate threadingly with the fuse access cap screw 32. Forward of the rear armature frame support 29, the remainder of the hollow center of the armature frame 24 is shaped as a second cavity coaxial with housing 22 to closely nest the referred to standard tubular fuse 30. The primary means to install and replace a fuse 30 is through the barrel 26, by removing the tool cushion 34 and fuse access cap screw 32. Implicitly, the dimension of the fuse access cap screw 32 must be slightly in excess of the diameter of the fuse 30, to allow sliding passage of the fuse 30.

A circular mounting board 36 is mounted against the rear armature frame support 29, in an orientation parallel to the diameter of the armature frame 24. In addition to its electrical functions, component mounting board 36 also serves to seal off from the outside the hollow space in the armature frame 24 containing the fuse 30. Mounting board 36 is constructed of a dielectric material.

The rear armature frame support 29 extends outwardly as a cylinder, but has a coaxially centered interior hollow space providing a third cavity shaped to accommodate the mounting board 36. A power plug 38 mounted on mounting board 36 has two conducting prongs 39*a*, 39*b* which protrude outward from the rear end of the device 10, to provide an electrical power connection for the device 10 suitable for plugging into either a standard electrical wall socket or an extension cord. Power plug 38 and mounting board 36 are covered by a protective dielectric potting material 40 proximate to said mounting board 36, as is the exposed surface in the rear armature frame support 29. Potting material 40 is most suitably composed of a unitary piece of material held in place by a potting lock groove 42 extending around the circumference of the interior of the rear armature frame support 29.

The device 10 is activated by a manually operable on/off push button switch 44. Push button switch 44 is mounted in a removeable threaded plate 23 in housing 22 immediately opposite a first conducting contact surface 47 on the tubular fuse 30. Push button switch 44 has an electrically conducting contact shaft 45 attached to its underside. The push button switch 44 and its contact shaft 45 are mounted on a compressible metal spring 46. The armature frame 24 is provided with a hole 21 large enough for loosely receiving the contact shaft 45, so that when the push button switch 44 is manually depressed, the contact shaft 45 makes electrical contact with first contact surface 47 on fuse 30, and spring 46 is compressed. When push button switch 44 is released, the spring 46 forces the contact shaft 45 and push button switch 44 to move outward away from first contact surface 47, causing a breaking of electrical contact between shaft 45 and first contact surface 47.

A first flexible conductor 48 passes through hole 43 and connects contact shaft 45 to one end of the windings 28. The opposite end of the windings 28 connects to one end of a second wire 49 which passes through a hole 50 in the armature frame 24 and connects at its other end to prong 39*a*. The connection between second wire 49 and prong 39*a* may be direct or through a conducting conduit in the electrically insulating component mounting board 36. The other prong 39*b* connects to an electrically conducting contact plate 37. A metal spring 33 connects on one side to a second conducting contact surface 35 on fuse 30 and on the opposite side through component mounting board 36 to prong 39*b*. Accordingly, it may be seen that pressing push button switch 44 causes the completion of a complete electrical circuit through the windings 28, thus setting up a magnetic field whose flux is concentrated in barrel 26 for so long as push button switch 44 is depressed.

As may be inferred, a variety of suitable dimensions are possible for device 10. However, one of the objects of the invention is that device 10 can be suitably made in a compact, easily transported and stored form. Typical dimensions for a preferred embodiment would be a length of about 5 inches, an exterior diameter for housing 22 of about 1.625 inches, and an interior diameter of barrel 26 of about 0.5 inches.

Figure 6:
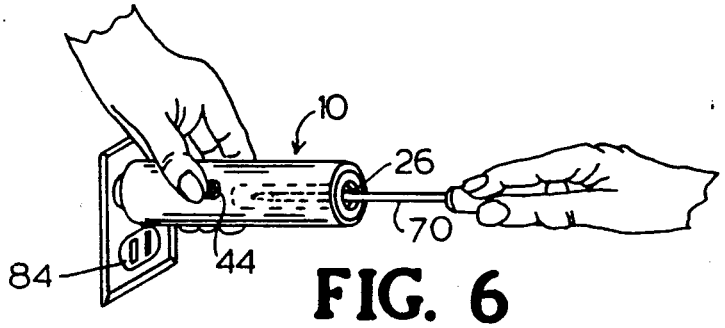
FIG. 6 is a side elevation view of the magnetizer/demagnetizer device installed in an electrical outlet and illustrating magnetization of a screwdriver.
Figure 7:
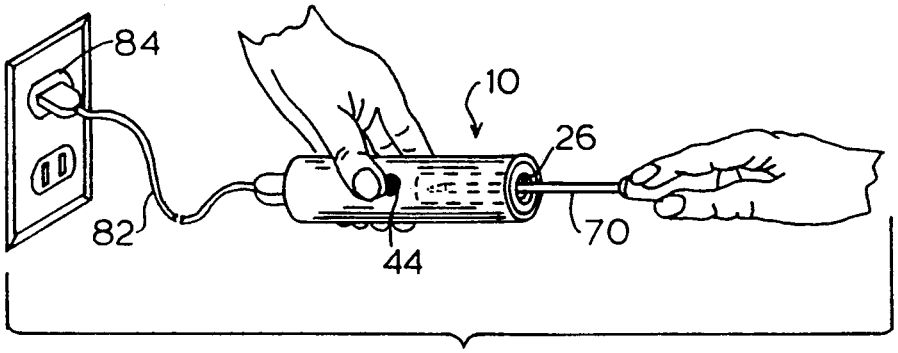
FIG. 7 illustrates the magnetizer/demagnetizer device connected to an electrical extension cord, and being used to magnetize a screwdriver.

The device 10 may be used without augmentation to magnetize or demagnetize objects by inserting them into the barrel 26 of the device. For example, to magnetize a screwdriver 70, the metal end of the screwdriver is inserted into the barrel 26 and is then held stationary while push button switch 44 is held depressed for at least one second, then releasing push button switch 44 before removing the screwdriver. To demagnetize the screwdriver, the metal end of the screwdriver should be inserted into the barrel and the push button switch 44 should then be depressed and held depressed while the screwdriver is slowly withdrawn from barrel 26. The use of the device 10 to magnetize a screwdriver is shown in FIGS. 6 and 7. Note in FIG. 6 that the device 10 is shown plugged into an extension cord 82 though for normal magnetizing use, the device 10 is plugged directly into wall outlet 84.

Figure 4:
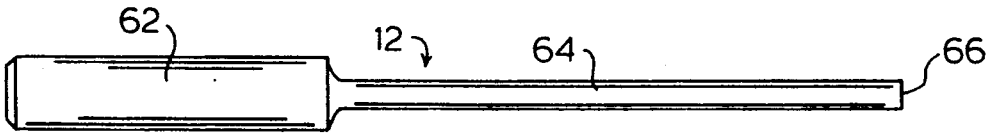
FIG. 4 is a side view of the pick-up probe.
Figure 5:
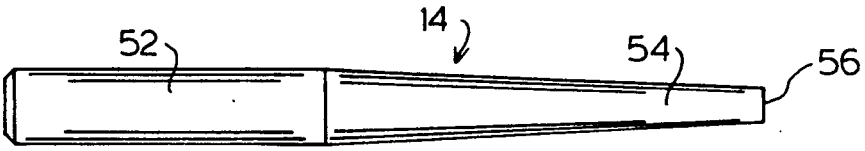
FIG. 5 is a side view of the degaussing probe.

Reference is next made to FIGS. 4 and 5. FIG. 4 shows a pick-up probe 12 while FIG. 5 shows a degaussing probe 14. It should be emphasized, however, that while probes 12, 14 are extremely useful augmentations to the device 10, they are not essential to the invention in its most basic form.

The pick-up probe 12 may be made from any suitable magnetic material capable of being easily magnetized to a reasonable strength by a surrounding external electromagnetic field and of being easily demagnetized when this external electromagnetic field is removed. Pick-up probe 12 has a cylindrical section 62 whose outer circumference closely matches that of the barrel 26, so that it can be removably inserted in barrel 26 in a closely nested fashion. From its front end, section 62 extends into a coaxially aligned cylindrical section 64, which tapers to a smaller diameter and terminates with a blunt tip 66. The diameter of a major portion of the length of lower section 64 should be of a size suitable for inserting into hard-to-reach places, such as holes and shafts, in order to retrieve ferrous items such as screws from such places.

Figure 8:
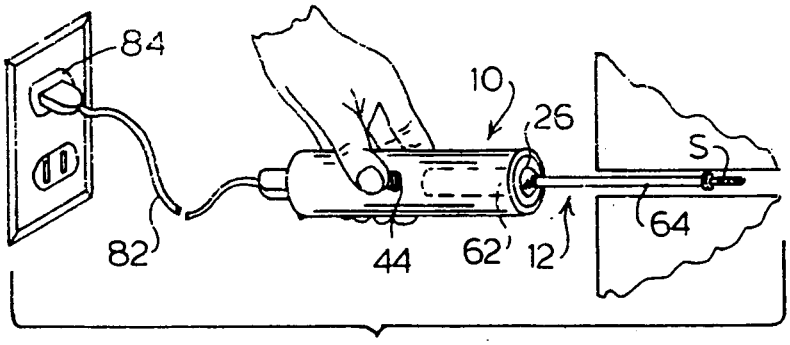
FIG. 8 illustrates the magnetizer/demagnetizer device connected to an electrical extension cord and being used in conjunction with the pick-up probe to retrieve a screw from a shaft hole.

Pick-up probe 12 is operated by inserting its end 62 into the barrel 26 of device 10, inserting the tip 66 and opposite end 64 into the space where the item is to be retrieved, and holding the push button switch 44 depressed to activate the device 10. After the item is successfully retrieved, the push button switch 44 is released, releasing the item. The use of the pick-up probe 12 to retrieve screws from a recessed location is shown in FIG. 8.

The degaussing probe 14 may also be made from any suitable magnetic material capable of being easily magnetized to a reasonable strength by a surrounding external electromagnetic field and of being easily demagnetized when such field is removed. Degaussing probe 14 has a cylindrical section 52 whose outer circumference closely matches that of the barrel 26, so that it can be removably inserted in barrel 26 in a closely nested fashion. Section 52 extends into section 54 which gradually tapers in conical fashion until it terminates with a blunt tip 56.

Figure 9:
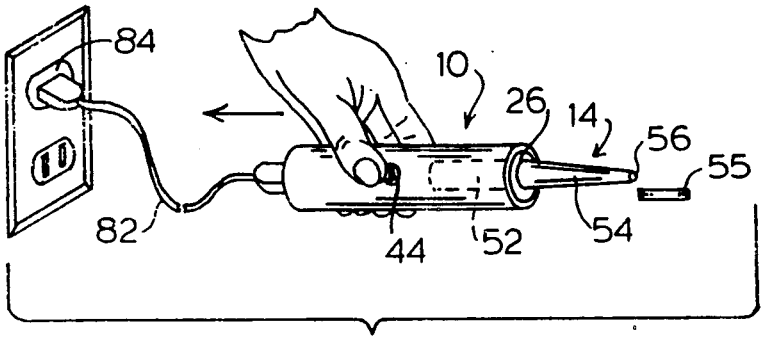
FIG. 9 illustrates the magnetizer/demagnetizer device being used in conjunction with the degaussing probe to demagnetize a magnetized record player part.

Degaussing probe 14 is operated by inserting the end 52 thereof into the barrel 26 of device 10, moving probe 14 into close proximity with the item 55 to be demagnetized such as a record player part, pressing the push button switch 44 to activate the device 10, and then withdrawing the degaussing probe 14 slowly away from the item to be demagnetized, and releasing the push button switch 44 after withdrawing probe 14 a suitable distance. The steps may be repeated as a cycle if necessary to achieve a satisfactory degree of demagnetization while the end 52 of the degaussing probe 14 remains in the barrel 26. The use of the degaussing probe to demagnetize a phonograph cartridge 55 by way of example is illustrated in FIG. 9.

I claim:

1. A portable, compact magnetizing/demagnetizing device, comprising:

(a) an outer tubular open ended elongated housing formed of an electrically insulating material;

(b)an inner tubular elongated member formed of an electrically insulating material and supported coaxially within said outer housing and extending for at least a major portion of the length of said outer housing, said inner tubular member defining at one end a first cylindrical cavity coaxial with said inner tubular member and of sufficient depth and internal diameter to loosely receive a magnetizable elongated tool-like member of comparable length and size to said first cavity an at an opposite end a second smaller cylindrical cavity coaxial with said inner tube member and axially aligned with said first cavity and suitable for storing a replaceable tubular electrical fuse;

(c) an electrical coil wound around said inner tubular member and surrounding only said first cavity and terminating with first and second leads at the ends of said coil;

(d) an electrical plug assembly fixedly mounted on said inner tubular member externally of said second cavity, including first and second prongs extending outwardly from said second cavity and suited to being inserted in and energized from an AC wall outlet and when so inserted to provide support for said device, said second prong being electrically connected to said second coil lead;

(e) a tubular electrical fuse stored in said second cavity and extending between a first fuse contact end and a second fuse contact end, said second fuse contact end being electrically connected to said first prong;

(f) a spring release, loaded push button switch having one side connected to said first coil lead and including connection means operable when manually pressed to electrically connect said first coil lead to said fuse first contact end to complete a circuit from said first coil lead through said fuse to said first prong to cause said coil to be energized and a magnetic field established in said first cavity when both said prongs are energized from an AC supply;

(g) means for retaining and positioning said fuse in said second cavity including a screw cover formed of an electrically insulating material and removably secured in said inner tubular member over said fuse first contact end and a compressible metallic spring in said second cavity against which said fuse second contact end is adapted to be pressed when said screw cover is secured, said metallic forming an electrical connection in series with said second fuse contact end and said first prong, said screw cover also being operative to form a barrier between said first and second cavities; and (h) a cushioning pad formed of an electrically insulating material and mounted within said first cavity over said screw cover to absorb the impact of tool-like members inserted therein.

2. A magnetizing/demagnetizing device as claimed in claim 1 wherein said inner tubular member includes a pair of first, second longitudinally spaced annular protrusions providing support for said inner tubular member within said first cavity and between which said coil is mounted and a third annular protrusion providing support for said inner tubular member at the end of said housing opposite said first cavity, said third annular protrusion being formed so as to provide a third cavity surrounding a portion of said prongs and the connections made thereto.

3. A magnetizing/demagnetizing device as claimed in claim 1 wherein said push button switch is positioned on the side and intermediate the length of said housing.

4. A magnetizing/demagnetizing device as claimed in claim 1 including an elongated probe formed to have one end magnetized while in said first cavity with such magnetization extending to an opposite end of said probe.

5. A portable, compact magnetizing/demagnetizing device, comprising:

(a) an outer tubular open ended elongated housing formed of an electrically insulating material;

(b) an inner elongated tubular member formed of an electrically insulating material and supported coaxially within said outer housing and extending for at least a major portion of the length of said outer housing, said inner tubular member defining at one end a first cylindrical cavity coaxial with said inner tubular member and of sufficient depth and internal diameter to loosely receive through an open outer end of said first cavity a magnetizable elongated tool-like member of comparable length and size to said first cavity, an opposite inner end of said cavity being closed by means providing a stop for limiting the depth of entry of said tool member like;

(c) an electrical coil wound around said inner tubular member and surrounding only said first cavity and terminating with first and second leads at the ends of said coil;

(d) a pair of prongs suited for insertion into an AC outlet and fixedly mounted on said inner tubular member at the opposite end thereof and when so inserted being adapted to provide support for said device; and (e) a closure switch mounted on said housing and connected to said coil and prongs in a manner enabling said coil to be energized when said switch is closed and said prongs are energized.

6. A portable, compact magnetizing/demagnetizing device as claimed in claim 5, wherein said inner tubular member defines at an opposite end a second fuse receptacle cavity axially aligned with said first cavity, a fuse stored in said second cavity and connected in series with said coil.

7. A portable, compact magnetizing/demagnetizing device as claimed in claim 6 wherein said switch comprises a spring release contact switch and includes means for establishing an electrical connection between one end of said fuse and one end of said coil to complete the circuit necessary for energizing said coil.

* * * * *

UNITED STATES PATENT AND TRADEMARK OFFICE

CERTIFICATE OF CORRECTION

PATENT NO. : 5,055,813

DATED : October 8, 1991

INVENTOR(S) : Terry R. Johnson

It is certified that error appears in the above-identified patent and that said Letters Patent is hereby corrected as shown below:

Column 6, line 1, correct "an" (first appearance) to read --and--.

Column 6, line 23, delete "release'" . (PTO error)

Column 6, line 39, insert --spring-- after "metallic".

Column 7, line 15, change "tool member like" to read --tool-like member --.

Signed and Sealed this

Twenty-sixth Day of January, 1993

*Attest:*

STEPHEN G. KUNIN

*Attesting Officer*

*Acting Commissioner of Patents and Trademarks*